US010694294B2

(12) United States Patent
Xie et al.

(10) Patent No.: US 10,694,294 B2
(45) Date of Patent: Jun. 23, 2020

(54) METAL DIAPHRAGM AND SPEAKER

(71) Applicant: SHENZHEN GRANDSUN ELECTRONIC CO., LTD., Shenzhen, Guangdong (CN)

(72) Inventors: Gang Xie, Shenzhen (CN); Haiquan Wu, Shenzhen (CN); Weiyong Gong, Shenzhen (CN); Mickael Bernard Andre Lefebvre, Shenzhen (CN); Ruiwen Shi, Shenzhen (CN)

(73) Assignee: SHENZHEN GRANDSUN ELECTRONIC CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/247,353

(22) Filed: Jan. 14, 2019

(65) Prior Publication Data

US 2019/0335277 A1 Oct. 31, 2019

(30) Foreign Application Priority Data

Apr. 28, 2018 (CN) ..... 2018 2 0639372 U

(51) Int. Cl.

| | |
|---|---|
| ***H04R 25/00*** | (2006.01) |
| ***H04R 9/06*** | (2006.01) |
| ***H04R 7/18*** | (2006.01) |
| ***H04R 9/02*** | (2006.01) |
| ***H04R 7/12*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 2307/027* (2013.01)

(58) Field of Classification Search

CPC .... H04R 9/00; H04R 29/003; H04R 2209/00; H04R 2209/41; H04R 7/00; H04R 2207/00; H04R 7/06; H04R 7/12

See application file for complete search history.

(56) References Cited

U.S. PATENT DOCUMENTS 6,236,733 B1 * 5/2001 Kato ..... H04R 9/02 181/164
7,570,780 B2 * 8/2009 Baeten ..... H04R 7/12 381/423

(Continued)

*Primary Examiner* — Amir H Etesam

(74) *Attorney, Agent, or Firm* — Conley Rose, P.C.; Grant Rodolph

(57) ABSTRACT

An electro-acoustic product, and more particularly to a metal diaphragm and a speaker. The metal diaphragm includes a hemispherical diaphragm portion that is provided with a central convex, a hemispherical diaphragm portion periphery is extended in a horizontal direction and configured to form an annular flat diaphragm portion, a annular flat diaphragm portion periphery is folded toward the convex direction of the hemispherical diaphragm portion and configured to extend away from the hemispherical diaphragm portion to form a trumpet-shaped diaphragm portion; a height of a trumpet-shaped diaphragm outer periphery portion away from the hemispherical diaphragm portion is greater than a height of a top portion of the hemispherical diaphragm portion. Thereby the split distortion of the speaker at high-frequency is reduced to ensure that the metal diaphragm can be normally vibrated to produce sound.

17 Claims, 6 Drawing Sheets

(56) References Cited

U.S. PATENT DOCUMENTS

| | | | | |
|---|---|---|---|---|
| 7,711,138 | B2 * | 5/2010 | Howze | H04R 7/20 381/398 |
| 8,422,724 | B2 * | 4/2013 | Corynen | H04R 7/14 381/398 |
| 2003/0185415 | A1 * | 10/2003 | Funahashi | H04R 9/043 381/398 |
| 2012/0321124 | A1 * | 12/2012 | Chen | H04R 7/122 381/423 |
| 2017/0180865 | A1 | 6/2017 | Fujitani et al. | |

* cited by examiner

METAL DIAPHRAGM AND SPEAKER

CROSS REFERENCE

This application claims priority of Chinese Patent Application No. 201820639372.2 filed on Apr. 28 2018, entitled "a metal diaphragm and a speaker", which is hereby incorporated herein by reference as if fully set forth herein.

TECHNICAL FIELD

The present application relates to the technical field of an electro-acoustic product, and more particularly to a metal diaphragm and a speaker.

BACKGROUND

In recent years, since the requirement of functional characteristics of the speaker is increasing on the market, the diaphragm is one of the main components of the vibration sounding of the speaker, the quality of the diaphragm determines the effective frequency range, distortion and sound quality of the speaker, and the diaphragm is a key design to control the sound effect of the speaker. However, the performance of the diaphragm depends on the geometry, the material and the like of the diaphragm; the traditional diaphragm is generally designed as a linear structure or a conical basin-shaped structure, and the material thereof is mostly made of paper, plastic or aluminum, and aluminum alloy and the like. However, the rigidity of the diaphragm of this type of structure or material is not enough, thereby split vibration is easy to be occurred, when the speaker is vibrated at high-frequency, and the sound effect of the speaker is affected.

SUMMARY

An object of the present application is to provide a speaker to solve the technical problem that the split vibration is easy to be occurred in the speaker due to the rigidity of the vibration system is not enough in the prior art.

In order to achieve the above object, the technical solution is adopted by the present application that a metal diaphragm, including: a hemispherical diaphragm portion that is provided with a central convex, a periphery of the hemispherical diaphragm portion is extended in a horizontal direction and configured to form an annular flat diaphragm portion, a periphery of the annular flat diaphragm portion is folded toward the convex direction of the hemispherical diaphragm portion and configured to extend away from the hemispherical diaphragm portion to form a trumpet-shaped diaphragm portion; a height of an outer periphery of the trumpet-shaped diaphragm portion away from the hemispherical diaphragm portion is greater than a height of a top portion of the hemispherical diaphragm portion.

Further, a cross-section of the metal diaphragm is in a W-shaped.

Further, an upper surface and a lower surface of the annular flat diaphragm portion are regularly flat and both parallel to the horizontal plane.

Further, an angle between a joint of the annular flat diaphragm portion and the hemispherical diaphragm portion is 90° to 180°; and an angle between a joint of the annular flat diaphragm portion and the trumpet-shaped diaphragm portion is 90° to 180°.

Further, the hemispherical diaphragm portion, the annular flat diaphragm portion, and the trumpet-shaped diaphragm portion are made of pure magnesium material.

Further, the hemispherical diaphragm portion, the annular flat diaphragm portion, and the trumpet-shaped diaphragm portion are made of magnesium alloy material.

Further, a thickness of the metal diaphragm ranges from 6 to 50 micrometers (μm), or 60 to 300 μm.

Further, the hemispherical diaphragm portion, the annular flat diaphragm portion, and the trumpet-shaped diaphragm portion are integrally formed.

Further, the hemispherical diaphragm portion, the annular flat diaphragm portion, and the trumpet-shaped diaphragm portion are integrally formed by stamping.

The present application has the beneficial effects that the metal diaphragm of the present application includes a hemispherical diaphragm portion, a trumpet-shaped diaphragm portion, and an annular flat diaphragm portion respectively connected to the hemispherical diaphragm portion and the trumpet-shaped diaphragm portion. Since the central portion of the hemispherical diaphragm portion is protruded outward, when the metal diaphragm is vibrated, the hemispherical diaphragm portion may be vibrated to generate a first force configured to act on the angular flat diaphragm portion to away from the hemispherical diaphragm portion; simultaneously, since the trumpet-shaped diaphragm portion is convexly disposed toward the hemispherical diaphragm portion, and when the metal diaphragm is vibrated, the trumpet-shaped diaphragm portion may generate a second force configured to act on the angular flat diaphragm portion away from the hemispherical diaphragm portion; the first force and the second force are simultaneously configured to be applied to the annular flat diaphragm portion, or the first force is configured to be transmitted to the trumpet-shaped diaphragm portion through the annular flat diaphragm portion, and the second force is transmitted to the hemispherical diaphragm portion through the annular flat diaphragm portion, and the first force and the second force are in opposite directions. When the first force and the second force are configured to act on the straightness structural annular flat diaphragm portion, the first force and the second force can be partially or completely counteracted, thereby the force which configured to cause the metal diaphragm to be deformed when the metal diaphragm is vibrated can be partially or completely counteracted, thereby the rigidity of the metal diaphragm can be improved, and the thickness of the metal diaphragm can be reduced and the damping characteristics of the metal diaphragm can be increased, when the rigidity is constant. Thereby the split distortion of the speaker at high-frequency is reduced to ensure that the metal diaphragm can be normally vibrated to produce sound.

Another technical solution of the present application is that a speaker includes a magnetic circuit system, a vibration system, a speaker support, and the metal diaphragm; the speaker support includes a frame and a U-shaped cup; the frame and the U-shaped cup are in fastening connection with each other to form a mounting cavity, the magnetic circuit system and the vibration system are mounted in the mounting cavity; and an outer periphery of the trumpet-shaped diaphragm portion away from the hemispherical diaphragm portion is fixedly connected with the frame.

Further, the magnetic circuit system includes a first magnetic assembly, a magnet assembly, and a second magnetic assembly sequentially stacked in the U-shaped cup, and the centers of the U-shaped cup, the first magnetic assembly, the magnet assembly, and the second magnetic assembly are located on the same line; the first magnetic assembly includes a first internal magnetic member and a first external magnetic member disposed around an outer periphery of the first internal magnetic member, and the first external magnetic member is spaced apart from the first internal magnetic member to form a first magnetic gap; the magnet assembly includes a central magnet and a peripheral magnet disposed around an outer periphery of the central magnet, and the peripheral magnet is spaced apart from the central magnet to form a second magnetic gap; the second magnetic assembly includes a second internal magnetic member and a second external magnetic member disposed around an outer periphery of the second internal magnetic member, and the second external magnetic member is spaced apart from the second internal magnetic member to form a third magnetic gap; the first magnetic gap, second magnetic gap, and the third magnetic gap are in communication with each other.

Further, the vibration system further includes a voice coil, a first end of the voice coil is fixedly connected to the metal diaphragm, and a second end of the voice coil is configured to sequentially pass through the third magnetic gap and the second magnetic gap and is suspended in the first magnetic gap.

Further, the speaker further includes a damping enhancement system, and the damping enhancement system includes a first damping member configured to sealingly cover an outer bottom of the frame and a second damping member configured to sealingly cover an outer bottom of the U-shaped cup.

The speaker of the present application, since the metal diaphragm described above is used, the split vibration of the speaker during high-frequency can be reduced, and the high-frequency curve of the speaker is smoother. The sensitivity of sound of the speaker is improved, and the user's hearing experience is improved.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

Figure 1:
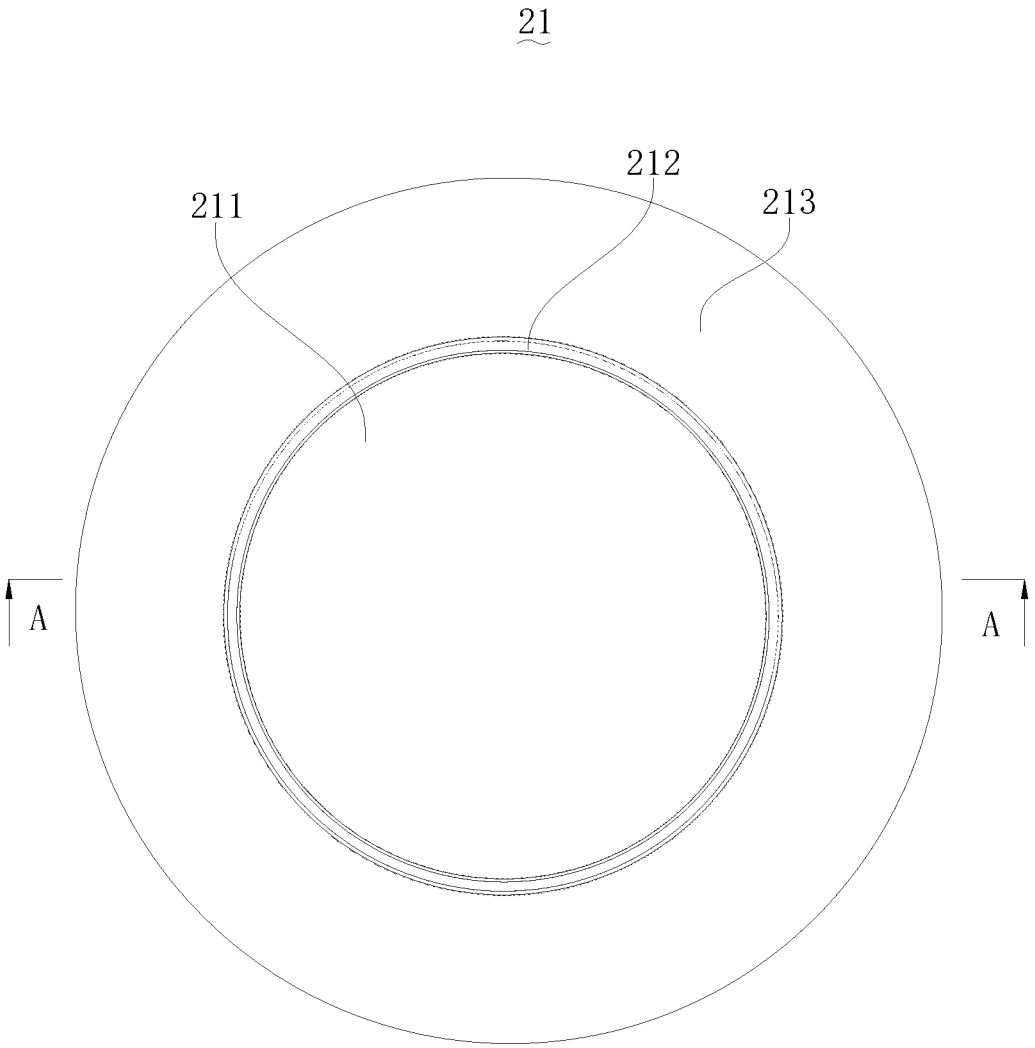
FIG. 1 is a schematic structural view of a metal diaphragm provided in first embodiment of the present application.

In which, the reference numerals are listed as follows: 10—magnetic circuit system, 11—first magnetic assembly, 12—magnet assembly, 13—second magnetic assembly, 20—vibration system, 21—metal diaphragm, 22—voice coil, 30—speaker support, 31—U-shaped cup, 32—frame, 40—damping enhancement system, 41—first damping member, 42—second damping member, 50—circuit board, 111—first internal magnetic member, 112—first external magnetic member, 113—first magnetic gap, 121—central magnet, 122—peripheral magnet, 123—second magnetic gap, 131—second internal magnetic member, 132—second external magnetic member, 133—third magnetic gap, 211—hemispherical diaphragm portion, 212—annular flat diaphragm portion, 213—trumpet-shaped diaphragm portion, 311—positioning cylinder, and 312—receiving groove, 1211—central magnet unit, and 1221—peripheral magnet unit.

DETAILED DESCRIPTION OF THE EMBODIMENTS

The embodiments of the present application are described in detail, and examples of the embodiment are illustrated in the accompanying figures; wherein, an always-unchanged reference number or similar reference numbers represent(s) identical or similar components or components having identical or similar functionalities. The embodiment described below with reference to the accompanying FIGS. 1-6 are illustrative and intended to illustrate the present application, but should not be considered as any limitation to the present application.

In the description of the present application, it needs to be understood that, directions or location relationships indicated by terms such as "length", "width", "up", "down", "front", "rear", "left", "right", "vertical", "horizontal", "top", "bottom", "inside", "outside", and so on are the directions or location relationships shown in the accompanying figures, which are only intended to describe the present application conveniently and simplify the description, but not to indicate or imply that an indicated device or component must have specific locations or be constructed and manipulated according to specific locations; therefore, these terms shouldn't be considered as any limitation to the present application.

In addition, terms "the first" and "the second" are only used in describe purposes, and should not be considered as indicating or implying any relative importance, or impliedly indicating the number of indicated technical features. As such, technical feature(s) restricted by "the first" or "the second" can explicitly or impliedly comprise one or more such technical feature(s). In the description of the present application, "a plurality of" means two or more, unless there is additional explicit and specific limitation.

In the present application, unless there is additional explicit stipulation and limitation, terms such as "mount", "connect with each other", "connect", "fix", and so on should be generally interpreted, for example, "connect" can be interpreted as being fixedly connected, detachably connected, or connected integrally; "connect" can also be interpreted as being mechanically connected or electrically connected; "connect" can be further interpreted as being directly connected or indirectly connected through intermediary, or being internal communication between two components or an interaction relationship between the two components. For one of ordinary skill in the art, the specific meanings of the aforementioned terms in the present application can be interpreted according to specific conditions.

First Embodiment

As shown in FIGS. 1 to 6, the present application provides a metal diaphragm 21, including: a hemispherical diaphragm portion 211 that is provided with a central convex, a periphery of the hemispherical diaphragm portion 211 is extended in a horizontal direction and configured to form an annular flat diaphragm portion 212, a periphery of the annular flat diaphragm portion 212 is folded toward the convex direction of the hemispherical diaphragm portion 211 and configured to extend away from the hemispherical diaphragm portion 211 to form a trumpet-shaped diaphragm portion 213; a height of an outer periphery of the trumpet-shaped diaphragm portion 213 away from the hemispherical diaphragm portion 211 is greater than a height of a top portion of the hemispherical diaphragm portion 211.

In the metal diaphragm 21 of the present application, since the hemispherical diaphragm portion 211 of the metal diaphragm 21 is a hemispherical structure that is provided with a convex outward at the central portion thereof, and when the metal diaphragm 21 is vibrated, the hemispherical diaphragm portion 211 may be vibrated to generate a first force configured to act on the angular flat diaphragm portion to away from the hemispherical diaphragm portion 211; simultaneously, since the trumpet-shaped diaphragm portion 213 is convexly disposed toward the hemispherical diaphragm portion 211, and when the metal diaphragm 21 is vibrated, the trumpet-shaped diaphragm portion 213 may generate a second force configured to act on the angular flat diaphragm portion to away from the hemispherical diaphragm portion 211; the first force and the second force are simultaneously configured to be applied to the annular flat diaphragm portion 212, or the first force is transmitted to the trumpet-shaped diaphragm portion 213 through the annular flat diaphragm portion 212, and the second force is transmitted to the hemispherical diaphragm portion 211 through the annular flat diaphragm portion 212, and the first force and the second force are in opposite directions. When the first force and the second force are configured to act on the straightness structural annular flat diaphragm portion 212, the first force and the second force can be partially or completely counteracted, thereby the force which configured to cause the metal diaphragm 21 to be deformed when the metal diaphragm 21 is vibrated can be partially or completely counteracted, thereby the rigidity of the metal diaphragm 21 can be improved, and the thickness of the metal diaphragm can be reduced and the damping characteristics of the metal diaphragm 21 can be increased, when the rigidity is constant, thereby the split distortion of the speaker at high-frequency is reduced to ensure that the metal diaphragm 21 can be normally vibrated to produce sound.

However, in the metal diaphragm 21 of the present application, the height of the periphery of the trumpet-shaped diaphragm portion 213 away from the hemispherical diaphragm portion 211 is greater than the height of the central portion of the hemispherical diaphragm portion 211. Thus, the hemispherical diaphragm portion 211 can be vibrated in a vibration space formed by the trumpet-shaped diaphragm portion 213, a larger vibration space is provided to the hemispherical diaphragm portion 211, and the vibration frequency range of the metal diaphragm 21 can be effectively expanded.

In the present embodiment, the cross-section of the metal diaphragm 21 is in a W-shaped. As shown by the broken line in FIG. 2, the cross-section of the metal diaphragm 21 herein in a W-shaped means that a highest point of the trumpet-shaped diaphragm portion 213, a midpoint of the annular flat diaphragm portion 212 on the left side of the hemispherical diaphragm portion 211, a midpoint of the annular flat diaphragm portion 212 on the right side of the hemispherical diaphragm portion 211, and a vertex of the hemispherical diaphragm portion 211 in a same cross-section, and the above four points are sequentially connected to form a W-shaped cross-section of the metal diaphragm 21 of the present embodiment.

Figure 2:
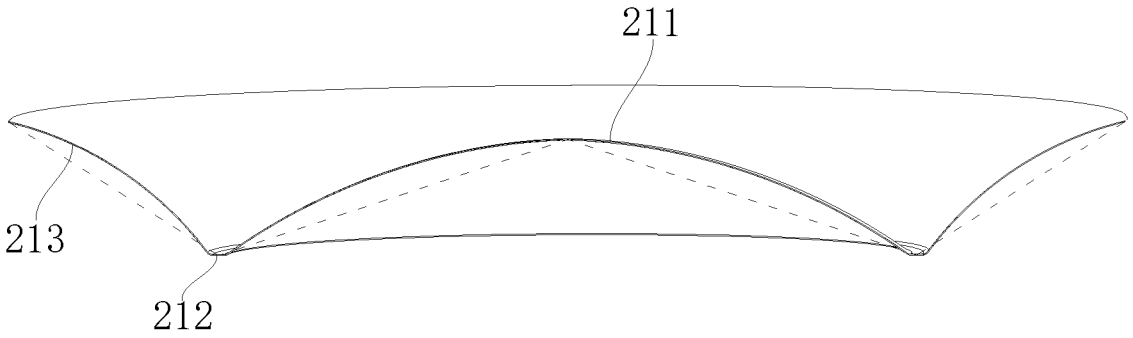
FIG. 2 is a cross-sectional view taken along line A-A of FIG. 1.
Figure 6:
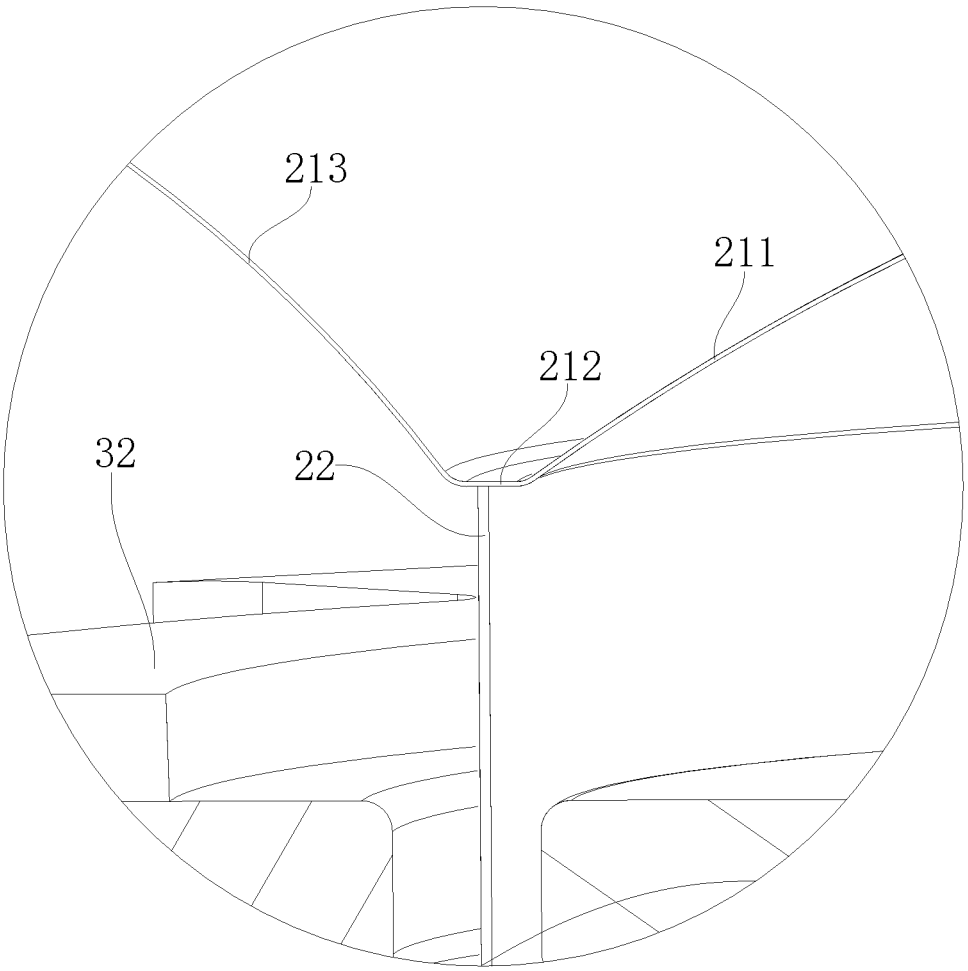
FIG. 6 is an enlarged view of portion A of FIG. 5.

In the present embodiment, as shown in FIG. 2 and FIG. 6, the upper and lower surfaces of the annular flat diaphragm portion 212 are regularly flat and both parallel to the horizontal plane. When the metal diaphragm 21 is fixed in the speaker support and connected with a voice coil 22, the voice coil 22 is configured to only need to be bonded to the lower surface of the annular flat diaphragm portion 212, that is, the annular flat diaphragm portion 212 is configured to act as a positioning structure for the voice coil 22, so that the connection between the voice coil 22 and the metal diaphragm 21 can be more convenient, the operation is simpler, and the conformity of the voice coil 22 can be improved due to the flat surface structure of the annular flat diaphragm portion 212, thereby the connection stability of the voice coil 22 is not affected due to the uneven surface of the annular flat diaphragm portion 212. In addition, when the metal diaphragm 21 is stressed to vibrate, the annular flat diaphragm portion 212 is also stressed to vibrate, and when the annular flat diaphragm portion 212 is vibrated, there is only generated a force in the up and down directions, and does not being generated a horizontal force due to the annular flat diaphragm portion 212 is designed as a flat structure with double sides flatness; while in the case of the annular flat diaphragm portion 212, such horizontal force is not conducive for vibrating to produce sound, which not only affects the normal vibration of the metal diaphragm 21, but may even cause the metal diaphragm 21 to deform.

In the embodiment, as shown in FIG. 6, the angle between the joint of the annular flat diaphragm portion 212 and the hemispherical diaphragm portion 211 is 90° to 180°; the angle between the joint of the annular flat diaphragm portion 212 and the trumpet-shaped diaphragm portion 213 is also 90°~180°. That is, the hemispherical diaphragm portion 211 is transited to the annular flat diaphragm portion 212 in a gentle obtuse angle form, and the annular flat diaphragm portion 212 is also transited to the trumpet-shaped diaphragm portion 213 in a gentle obtuse angle form, thereby the strength of the connection transition portion can be improved, it is not easily to be broken by a lateral force, and the overall structural stability of the metal diaphragm 21 can be better ensured.

In the present application, the metal diaphragm 21 is preferably made of a pure magnesium material; since the density of the magnesium metal is smaller, the density of the magnesium metal is only 1.74 kilograms (kg)/cubic meter ($m^3$), a higher sensitivity of the speaker can be ensured by adopting the magnesium metal to manufacture the metal diaphragm 21; and since the magnesium metal can be configured to absorb external vibration, thereby a better damping characteristic of the metal diaphragm 21 can be provided due that the metal diaphragm 21 is made of magnesium metal; in addition, the magnesium metal also has good ductility, and the thickness of the diaphragm can be reduced in the case of a certain rigidity, so that the damping characteristic of the metal diaphragm 21 can be further increased. Therefore, the metal diaphragm 21 of the present embodiment is made of a magnesium metal material, so that the manufactured diaphragm can not only retain the rigidity of the metal, but also has good damping characteristic, the split distortion of the speaker can be weakened, and a better sensitivity of speaker can also be ensured. In the present application, the hemispherical diaphragm portion 211, the annular flat diaphragm portion 212, and the trumpet-shaped diaphragm portion 213 may all be made of a magnesium alloy material, and the magnesium alloy herein refers to a magnesium alloy material containing more than 96% of a magnesium component, such as AZ13B magnesium alloy, etc. This kind of magnesium alloy has higher strength, better plasticity, and is easy to be made into a thin plate structure, the requirements for the diaphragm thickness of metal diaphragm 21 can be satisfied greatly, therefore the rigidity of the diaphragm is increased, the damping characteristic is improved, and the speaker distortion is reduced.

In the present embodiment, a thickness of the metal diaphragm 21 preferably ranges from 6 micrometers (μm) to 50 μm, or from 60 μm to 300 μm, different thicknesses of the metal diaphragms 21 corresponding to different rigidity strengths, and the rigidity thereof is increased synchronously with the increasing of the thickness of the metal diaphragm 21, so when the speaker is designed, the thickness of the metal diaphragm 21 can be selected according to the rigidity required by the speaker, and the thickness herein is not particularly limited. Specifically, it may be 6 μm, 30 μm, 50 μm, 60 μm, 90 μm, 120 μm, 150 μm, 180 μm, 210 μm, 240 μm, 270 μm or 300 μm.

In the present embodiment, the hemispherical diaphragm portion 211, the annular flat diaphragm portion 212, and the trumpet-shaped diaphragm portion 213 are integrally formed, since the hemispherical diaphragm portion 211, the annular flat diaphragm portion 212, and the trumpet-shaped diaphragm portion 213 are integrally formed, the manufactured metal diaphragm 21 is configured to have good continuity, and the vibration process of the metal diaphragm 21 is more stabilization, the normal vibration of the metal diaphragm 21 cannot be affected due to the gap between the three thereof. Moreover, since the density of the magnesium metal and the magnesium alloy metal material is small density, the texture is brittle, and they are easily to be broken by a force when being bent, and the above-mentioned annular flat diaphragm portion 212 is configured to play a function of connection and transition between the hemispherical diaphragm portion 211 and the trumpet-shaped diaphragm portion 213. The problem that the hemispherical diaphragm portion 211 being directly folded to form a trumpet-shaped diaphragm portion 213 is difficult is solved, and the transition between the hemispherical diaphragm portion 211 and the trumpet-shaped diaphragm portion is more stable and reliable.

In the present embodiment, the hemispherical diaphragm portion 211, the annular flat diaphragm portion 212, and the trumpet-shaped diaphragm portion 213 are preferably integrally formed by stamping. The metal diaphragm 21 of the present embodiment is preferably made of integral and flaky pure magnesium metal material or magnesium metal alloy material that is formed by a stamping machine at one stamping, thus, the metal diaphragm 21 can be made thin enough, and the unnecessary deformation of the metal diaphragm 21 cannot be caused due to the stamping process, and the superior performance of the pure magnesium metal and magnesium metal alloy of the metal diaphragm 21 can be ensured.

Second Embodiment

As shown in FIGS. 3 to 6, the second embodiment of the present application provides a speaker, the speaker of the present embodiment includes a magnetic circuit system 10, a vibration system 20, a speaker support 30, and the metal diaphragm 21; the speaker support 30 includes a frame 32 and a U-shaped cup 31; the frame 32 and the U-shaped cup 31 are in fastening connection with each other to form a mounting cavity, the magnetic circuit system 10 and the vibration system 20 are mounted in the mounting cavity; and an outer periphery of the trumpet-shaped diaphragm portion 213 away from the hemispherical diaphragm portion 211 is fixedly connected with the frame 32.

The speaker of the present application, since the metal diaphragm 21 described above is used, the split vibration of the speaker during high-frequency can be reduced, and the high-frequency curve of the speaker is smoother. The sensitivity of sound of the speaker is improved, and the user's hearing experience is improved.

In the present embodiment, the hemispherical diaphragm portion 211, the annular flat diaphragm portion 212, and the trumpet-shaped diaphragm portion 213 are collectively constituted a W-shaped cross-section of the metal diaphragm 21. Since the hemispherical diaphragm portion 211 of the metal diaphragm 21 is a dome-shaped structure in which the center portion is protruded outward. Therefore, when the metal diaphragm 21 is vibrated, the hemispherical diaphragm portion 211 may be vibrated to generate a first force configured to act on the angular flat diaphragm portion to away from the hemispherical diaphragm portion 211; simultaneously, since the trumpet-shaped diaphragm portion 213 is convexly disposed toward the hemispherical diaphragm portion 211, and when the metal diaphragm 21 is vibrated, the trumpet-shaped diaphragm portion 213 may generate a second force configured to act on the angular flat diaphragm portion away from the hemispherical diaphragm portion 211; the first force and the second force are simultaneously configured to be applied to the annular flat diaphragm portion 212, or the first force is transmitted to the trumpet-shaped diaphragm portion 213 through the annular flat diaphragm portion 212, and the second force is transmitted to the hemispherical diaphragm portion 211 through the annular flat diaphragm portion 212, and the first force and the second force are in opposite directions. When the first force and the second force are configured to act on the straightness structural annular flat diaphragm portion 212, the first force and the second force can be partially or completely counteracted, thereby the force which configured to cause the metal diaphragm 21 to be deformed when the metal diaphragm 21 is vibrated can be partially or completely counteracted, thereby the rigidity of the metal diaphragm 21 can be improved, and the thickness of the metal diaphragm can be reduced and the damping characteristics of the metal diaphragm 21 can be increased, when the rigidity is constant, thereby the split distortion of the speaker at high-frequency is reduced to ensure that the metal diaphragm 21 can be normally vibrated to produce sound.

However, in the metal diaphragm 21 of the present application, the height of the periphery of the trumpet-shaped diaphragm portion 213 away from the hemispherical diaphragm portion 211 is greater than the height of the central portion of the hemispherical diaphragm portion 211. Thus, the hemispherical diaphragm portion 211 can be vibrated in a vibration space formed by the trumpet-shaped diaphragm portion 213, a larger vibration space is provided to the hemispherical diaphragm portion 211, and the vibration frequency range of the metal diaphragm 21 can be effectively expanded.

Figure 3:
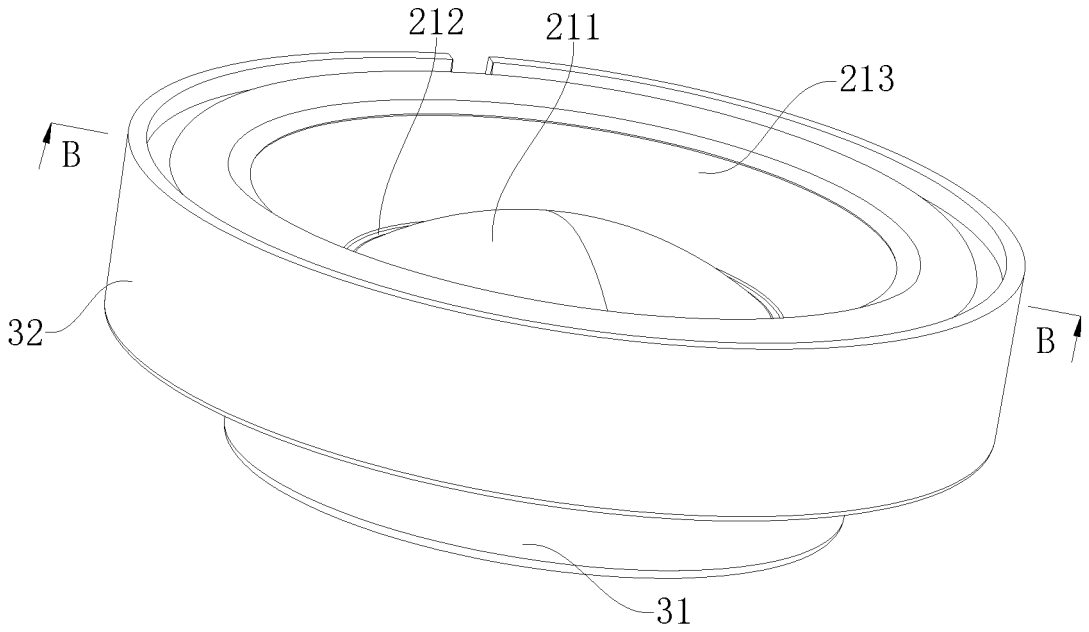
FIG. 3 a schematic structural view of a speaker provided in second embodiment of the present application.
Figure 5:
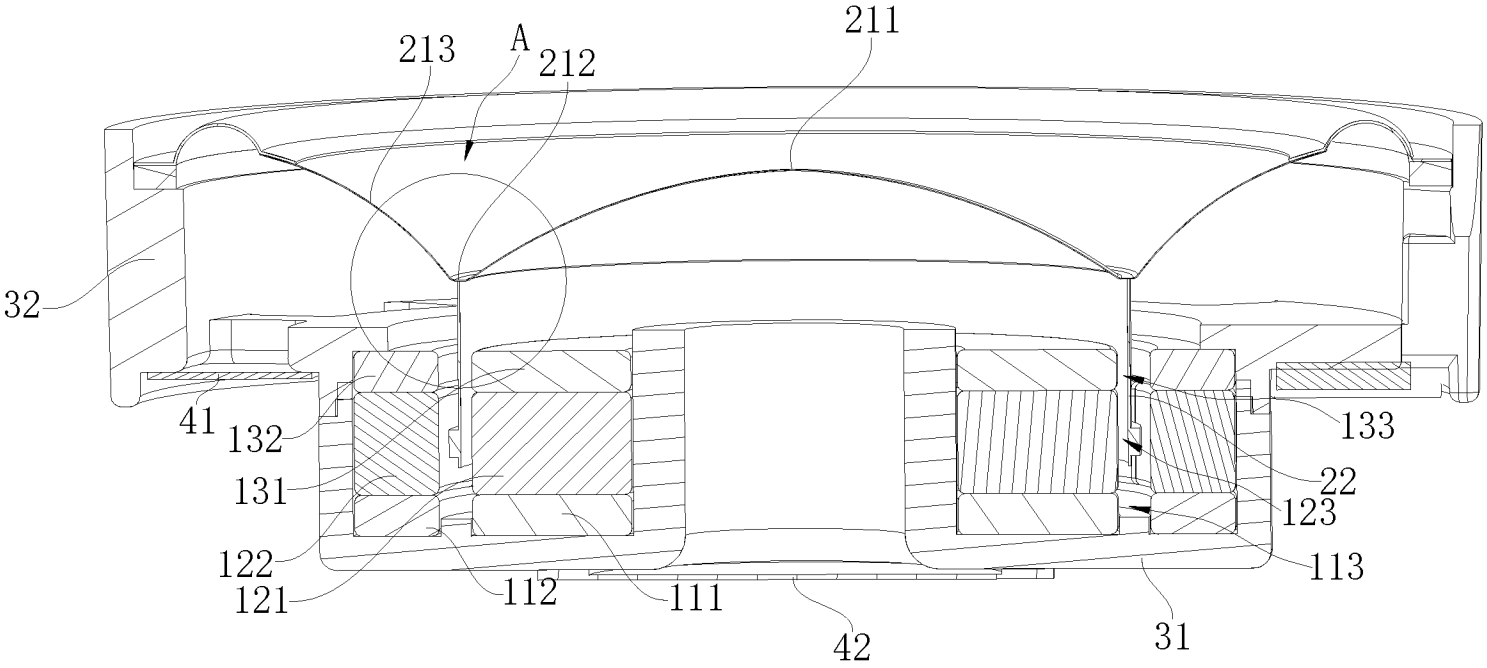
FIG. 5 is a cross-sectional view taken along line B-B of FIG. 4.

In the present embodiment, as shown in FIGS. 3 and 5, the height of the periphery of the trumpet-shaped diaphragm portion 213 away from the hemispherical diaphragm portion 211 is greater than the height of the central portion of the hemispherical diaphragm portion 211, that is, the metal diaphragm 21 is substantially received inside the frame 32, which prevented from being disturbed and damaged by external environmental factors due to the metal diaphragm 21 protruding from the basin frame 32.

In the present embodiment, the metal diaphragm 21 is preferably made of a pure magnesium material. Since the density of the magnesium metal is smaller, the density of the magnesium metal is only 1.74 kg/m$^3$, a higher sensitivity of the speaker can be ensured by adopting the magnesium metal to manufacture the metal diaphragm 21; and since the magnesium metal can be configured to absorb external vibration, thereby a better damping characteristic of the metal diaphragm 21 can be provided due that the metal diaphragm 21 is made of magnesium metal; in addition, the magnesium metal also has good ductility, and the thickness of the diaphragm can be reduced in the case of a certain rigidity, so that the damping characteristic of the metal diaphragm 21 can be further increased. Therefore, the metal diaphragm 21 of the present embodiment is made of a magnesium metal material, so that the manufactured diaphragm can not only retain the rigidity of the metal, but also has good damping characteristic, the split distortion of the speaker can be weakened, and a better sensitivity of speaker can also be ensured.

In the present embodiment, the hemispherical diaphragm portion 211, the annular flat diaphragm portion 212, and the trumpet-shaped diaphragm portion 213 may all be made of a magnesium alloy material, and the magnesium alloy herein refers to a magnesium alloy material containing more than 96% of a magnesium component, such as AZ13B magnesium alloy, etc. This kind of magnesium alloy has higher strength, better plasticity, and is easy to be made into a thin plate structure, the requirements for the diaphragm thickness of metal diaphragm 21 can be satisfied greatly, therefore the rigidity of the diaphragm is increased, the damping characteristic is improved, and the speaker distortion is reduced.

In the present embodiment, a thickness of the metal diaphragm 21 preferably ranges from 6 μm to 50 μm, or from 60 μm to 300 μm, different thicknesses of the metal diaphragms 21 corresponding to different rigidity strengths, and the rigidity thereof is increased synchronously with the increasing of the thickness of the metal diaphragm 21, so when the speaker is designed, the thickness of the metal diaphragm 21 can be selected according to the rigidity required by the speaker, and the thickness herein is not particularly limited. Specifically, it may be 6 μm, 30 μm, 50 μm, 60 μm, 90 μm, 120 μm, 150 μm, 180 μm, 210 μm, 240 μm, 270 μm or 300 μm.

In the present embodiment, the hemispherical diaphragm portion 211, the annular flat diaphragm portion 212, and the trumpet-shaped diaphragm portion 213 are integrally formed, since the hemispherical diaphragm portion 211, the annular flat diaphragm portion 212, and the trumpet-shaped diaphragm portion 213 are integrally formed, the manufactured metal diaphragm 21 is configured to have good continuity, and the vibration process of the metal diaphragm 21 is more stabilization, the normal vibration of the metal diaphragm 21 cannot be affected due to the gap between the three thereof.

In the present embodiment, the hemispherical diaphragm portion 211, the annular flat diaphragm portion 212, and the trumpet-shaped diaphragm portion 213 are preferably integrally formed by stamping. The metal diaphragm 21 of the present embodiment is preferably made of integral and flaky pure magnesium metal material or magnesium metal alloy material that is formed by a stamping machine at one stamping, thus, the metal diaphragm 21 can be made thin enough, and the unnecessary deformation of the metal diaphragm 21 cannot be caused due to the stamping process, and the superior performance of the pure magnesium metal and magnesium metal alloy of the metal diaphragm 21 can be ensured.

Figure 4:
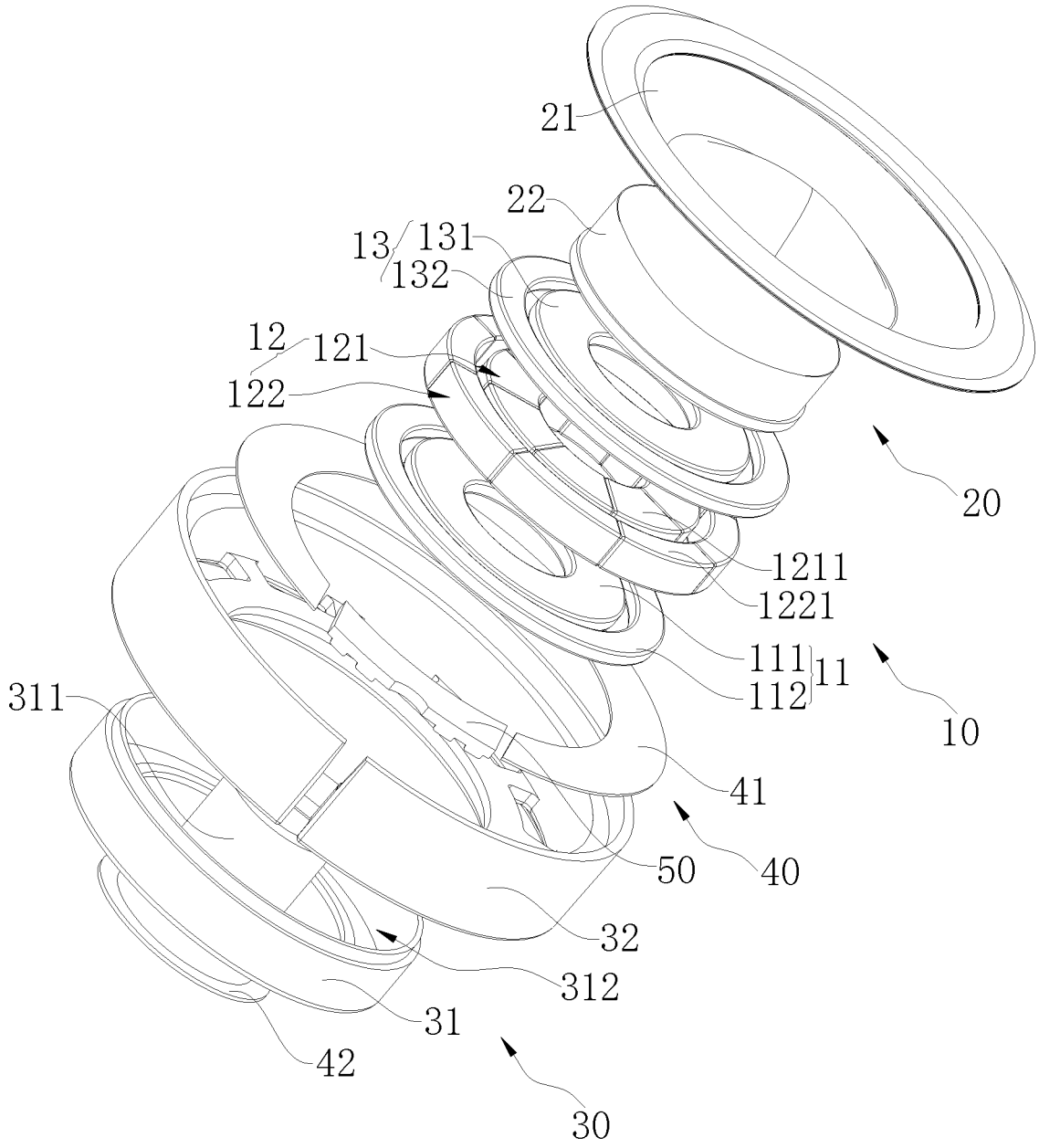
FIG. 4 is an explosion view of a speaker provided in second embodiment of the present application.

In the present embodiment, as shown in FIGS. 4 and 5, the magnetic circuit system 10 includes a first magnetic assembly 11, a magnet assembly 12, and a second magnetic assembly 13 sequentially stacked in the U-shaped cup 31, and the centers of the U-shaped cup 31, the first magnetic assembly 11, the magnet assembly 12, and the second magnetic assembly 13 are located on the same line; the first magnetic assembly 11 includes a first internal magnetic member 111 and a first external magnetic member 112 disposed around an outer periphery of the first internal magnetic member 111, and the first external magnetic member 112 is spaced apart from the first internal magnetic member 111 to form a first magnetic gap 113; the magnet assembly 12 includes a central magnet 121 and a peripheral magnet 122 disposed around an outer periphery of the central magnet 121, and the peripheral magnet 122 is spaced apart from the central magnet 121 to form a second magnetic gap 123; the second magnetic assembly 13 includes a second internal magnetic member 131 and a second external magnetic member 132 disposed around an outer periphery of the second internal magnetic member 131, and the second external magnetic member 132 is spaced apart from the second internal magnetic member 131 to form a third magnetic gap 133; the first magnetic gap 113, second magnetic gap 123, and the third magnetic gap 133 are in communication with each other.

Specifically, as shown in FIG. 4 and FIG. 5, a center portion of the U-shaped cup 31 is designed with a positioning cylinder 311, the positioning cylinder 311 and inner sidewalls and an inner bottom wall of the U-shaped cup 31 are enclosed into a receiving groove 312 configured to receive the first magnetic assembly 11, the second magnetic assembly 13, and the magnet assembly 12; and the central magnet 121, the first internal magnetic member 111 and the second internal magnetic member 131 are configured to be annular structures, when the first magnetic assembly 11, the second magnetic assembly 13, and the magnet assembly 12 are received in the receiving groove 312, the central magnet 121, the first internal magnetic member 111 and the second internal magnetic member 131 are respectively sleeved on the positioning cylinder 311 to achieve the purpose of preparing for positioning.

Specifically, as shown in FIG. 4 and FIG. 5, the peripheral magnet 122 includes a plurality of peripheral magnet units 1221 connected end to end, each of the peripheral magnet units 1221 is provided with a first internal magnetic end facing the center magnet 121 and a first external magnetic end facing away from the central magnet 121; the central magnet 121 includes a plurality of central magnet units 1211 connected end to end, each of the central magnet units 1211 provided with a second external magnetic end facing the peripheral magnet 122 and a second internal magnetic end facing away from the peripheral magnet 122; the magnetic pole of the first internal magnetic end is different from the magnetic pole of the second external magnetic end. The side surfaces of the two adjacent magnet units 1211 are contracted with each other. Similarly, the side surfaces of the adjacent two peripheral magnet units 1221 are contracted with each other, by such analogy, the plurality of central magnet units 1211 and the plurality of peripheral magnet units 1221 are respectively connected to form the central magnet 121 and the peripheral magnet 122, so that the magnetic pole of an outer ring portion of the central magnet 121 is different from the magnetic pole of an inner ring portion of the peripheral magnet 122, the flux leakage and hysteresis loss can be reduced due to the design of the magnetic circuit system 10, the uniform and symmetric distribution of the magnetic induction line can be further ensured, and the risk of distortion of the speaker can be further reduced to restore the realism of true sound reproduction. Specifically, the number of above-described peripheral magnet units 1221 is provided with N, the number of central magnet units 1211 is provided with M, and N is preferably configured to equal to M, and the N respective peripheral magnet units 1221 are disposed in one-to-one correspondence with the M respective central magnet units 1211. In this way, an end surface of the first internal magnetic end of the peripheral magnet unit 1221 can be opposite to an end surface of the second external magnetic end of the center magnet unit 1211 and parallel to each other, so that the uniformity of the magnetic induction line in the second magnetic gap 123 is not affected due to the existence of a connection gap, so that the distribution of the magnetic induction lines in the second magnetic gap 123 is more uniform.

More specifically, as shown in FIG. 4 and FIG. 5, the shape and size of the first internal magnetic member 111 and the second internal magnetic member 131 are configured to substantially equal to the shape and size of the central magnet 121, and the shape and size of the first external magnetic member 112 and the second external magnetic member 122 are configured to substantially equal to the shape and size of the peripheral magnet 122; and an upper surface of the first internal magnetic member 111 is attached to a lower surface of the central magnet 121, an upper surface of the first external magnetic member 112 is attached to a lower surface of the peripheral magnet 122, a lower surface of the second internal magnetic member 131 is attached to an upper surface of the central magnet 121, and a lower surface of the second external magnetic member 132 is attached to an upper surface of the peripheral magnet 122; and a side of the center magnet 121 is vertically aligned with sides of the first internal magnetic member 111 and the second internal magnetic member 131, a side of the peripheral magnet 122 is vertically aligned with sides of the first external magnetic member 112 and the second external magnetic member 132, so that the communication area among the first magnetic gap 113, the second magnetic gap 123, and the third magnetic gap 133 can be largest, and a largest space is provided for the forming of the magnetic induction line to improve the efficiency of sound production of the speaker.

In this embodiment, as shown in FIGS. 4-6, the vibration system 20 further includes a voice coil 22, and a first end of the voice coil 22 is fixedly connected to the metal diaphragm 21, that is, the voice coil 22 is in bonding fixed to a lower surface of the annular flat diaphragm portion 212 of the metal diaphragm 21, a second end of the voice coil 22 is configured to sequentially pass through the third magnetic gap 133 and the second magnetic gap 123 and being in suspension disposed in the first magnetic gap 113. The voice coil 22 is configured to act as a power source of the speaker of the present embodiment, and one end thereof is fixedly connected to the lower surface of the annular diaphragm portion 212 of the metal diaphragm 21, and the other end thereof is configured to sequentially pass through the third magnetic gap 133 and the second magnetic gap 123 and is suspended in the first magnetic gap 113, when an external audio current signal is transmitted to the voice coil 22, the magnetic induction lines in the first magnetic gap 113, the second magnetic gap 123, and the third magnetic gap 133 are cut by the voice coil 22 to generated mechanical vibration to cause the speaker to vibrate and to produce sound.

In this embodiment, as shown in FIG. 4 and FIG. 5, the speaker further includes a damping enhancement system 40, the damping enhancement system 40 includes a first damping member 41 configured to be covered on an outer bottom of the frame 32 and a second damping member 42 configured to be covered on an outer bottom of the U-shaped cup 31. The first damping member 41 and second damping member 42 are respectively arranged at the outer bottom of the frame 32 and the outer bottom of the U-shaped cup 31 to enhance the damping characteristic of the metal diaphragm 21, the vibration reaction force of the metal diaphragm 21 is reduced, and the vibration effect of the metal diaphragm 21 is increased, and the use of the metal diaphragm resulting sound quality deteriorate is avoided, and the sounding effect of the speaker is improved. Specifically, the first damping member 41 and the second damping member 42 of the present embodiment are both made of materials having good damping properties, such as damping paper, damping rubber, damping plastic and the like, which are commonly used in the market, and the damping paper with cheap price and excellent characteristics is preferable.

In this embodiment, as shown in FIG. 4, the speaker further includes a circuit board 50, the circuit board 50 is fixedly connected to the frame 32, and the circuit board 50 is electrically connected with the voice coil 22. The conduction between internal and external circuits of the speaker of the embodiment is realized via the circuit board 50, and the external audio signal current of the speaker is transmitted to inside of the speaker via the circuit board 50.

The above are only the preferred embodiments of the present application, and are not intended to limit the present application. Any modifications, equivalent substitutions or improvements made within the spirit and principles of the present application are included in the scope of the present application.

What is claimed is:

1. A metal diaphragm, comprising:

a hemispherical diaphragm portion provided with a central convex, wherein a periphery of the hemispherical diaphragm portion is extended in a horizontal direction and configured to form an annular flat diaphragm portion, wherein a periphery of the annular flat diaphragm portion is folded toward a convex direction of the hemispherical diaphragm portion and configured to extend away from the hemispherical diaphragm portion to form a trumpet-shaped diaphragm portion;

wherein a height of an outer periphery of the trumpet-shaped diaphragm portion away from the hemispherical diaphragm portion is greater than a height of a top portion of the hemispherical diaphragm portion, wherein the hemispherical diaphragm portion, the annular flat diaphragm portion, and the trumpet-shaped diaphragm portion are made of magnesium alloy material containing more than 96% of a magnesium component or are made of pure magnesium material, and wherein the hemispherical diaphragm portion, the annular flat diaphragm portion, and the trumpet-shaped diaphragm portion are integrally formed.

2. The metal diaphragm of claim 1, wherein a cross-section of the metal diaphragm is in a W-shaped.

3. The metal diaphragm of claim 1, wherein an upper surface and a lower surface of the annular flat diaphragm portion are regularly flat and both parallel to a horizontal plane.

4. The metal diaphragm of claim 1, wherein a first angle between a joint of the annular flat diaphragm portion and the hemispherical diaphragm portion is 90° to 180°, and wherein a second angle between the joint of the annular flat diaphragm portion and the trumpet-shaped diaphragm portion is 90° to 180°.

5. The metal diaphragm of claim 1, wherein a thickness of the metal diaphragm is from 6 to 50 micrometers (μm), or from 60 to 300 μm.

6. The metal diaphragm of claim 1, wherein the hemispherical diaphragm portion, the annular flat diaphragm portion, and the trumpet-shaped diaphragm portion are integrally formed by stamping.

7. A speaker, comprising:

a magnetic circuit system;

a vibration system;

a speaker support; and a metal diaphragm comprising a hemispherical diaphragm portion provided with a central convex, wherein a periphery of the hemispherical diaphragm portion is extended in a horizontal direction and configured to form an annular flat diaphragm portion, wherein a periphery of the annular flat diaphragm portion is folded toward a convex direction of the hemispherical diaphragm portion and configured to extend away from the hemispherical diaphragm portion to form a trumpet-shaped diaphragm portion, wherein a height of an outer periphery of the trumpet-shaped diaphragm portion away from the hemispherical diaphragm portion is greater than a height of a top portion of the hemispherical diaphragm portion, wherein the hemispherical diaphragm portion, the annular flat diaphragm portion, and the trumpet-shaped diaphragm portion are made of magnesium alloy material containing more than 96% of a magnesium component or are made of pure magnesium material, wherein the hemispherical diaphragm portion, the annular flat diaphragm portion, and the trumpet-shaped diaphragm portion are integrally formed, wherein the speaker support comprises a frame and a U-shaped cup;

wherein the frame and the U-shaped cup are in fastening connection with each other to form a mounting cavity, wherein the magnetic circuit system and the vibration system are mounted in the mounting cavity, and wherein the outer periphery of the trumpet-shaped diaphragm portion away from the hemispherical diaphragm portion is fixedly connected with the frame.

8. The speaker of claim 7, wherein the magnetic circuit system comprises a first magnetic assembly, a magnet assembly, and a second magnetic assembly sequentially stacked in the U-shaped cup, wherein a center of each of the U-shaped cup, the first magnetic assembly, the magnet assembly, and the second magnetic assembly are located on a same line, wherein the first magnetic assembly comprises a first internal magnetic member and a first external magnetic member disposed around an outer periphery of the first internal magnetic member, wherein the first external magnetic member is spaced apart from the first internal magnetic member to form a first magnetic gap, wherein the magnet assembly comprises a central magnet and a peripheral magnet disposed around an outer periphery of the central magnet, wherein the peripheral magnet is spaced apart from the central magnet to form a second magnetic gap, wherein the second magnetic assembly wherein a second internal magnetic member and a second external magnetic member disposed around an outer periphery of the second internal magnetic member, wherein the second external magnetic member is spaced apart from the second internal magnetic member to form a third magnetic gap, and wherein the first magnetic gap, second magnetic gap, and the third magnetic gap are in communication with each other.

9. The speaker of claim 8, wherein the vibration system further comprises a voice coil, wherein a first end of the voice coil is fixedly connected to the metal diaphragm, and wherein a second end of the voice coil is configured to sequentially pass through the third magnetic gap and the second magnetic gap and is suspended in the first magnetic gap.

10. The speaker of claim 7, wherein the speaker further comprises a damping enhancement system, and wherein the damping enhancement system comprises:

a first damping member configured to sealingly cover an outer bottom of the frame; and a second damping member configured to sealingly cover an outer bottom of the U-shaped cup.

11. The metal diaphragm of claim 1, wherein the hemispherical diaphragm portion is transited to the annular flat diaphragm portion in an obtuse angle form, and wherein the annular flat diaphragm portion is transited to the trumpet-shaped diaphragm portion in another obtuse angle form.

12. The metal diaphragm of claim 1, wherein the trumpet-shaped diaphragm portion is convexly disposed toward the hemispherical diaphragm portion.

13. A speaker, comprising:

a magnetic circuit system;

a vibration system;

a speaker support; and a metal diaphragm comprising a hemispherical diaphragm portion provided with a central convex, wherein a periphery of the hemispherical diaphragm portion is extended in a horizontal direction and configured to form an annular flat diaphragm portion, wherein a periphery of the annular flat diaphragm portion is folded toward a convex direction of the hemispherical diaphragm portion and configured to extend away from the hemispherical diaphragm portion to form a trumpet-shaped diaphragm portion, wherein a height of an outer periphery of the trumpet-shaped diaphragm portion away from the hemispherical diaphragm portion is greater than a height of a top portion of the hemispherical diaphragm portion, wherein the speaker support comprises a frame and a U-shaped cup, wherein the frame and the U-shaped cup are in fastening connection with each other to form a mounting cavity, wherein the magnetic circuit system and the vibration system are mounted in the mounting cavity, and wherein the outer periphery of the trumpet-shaped diaphragm portion away from the hemispherical diaphragm portion is fixedly connected with the frame.

14. The speaker of claim 13, wherein the hemispherical diaphragm portion is transited to the annular flat diaphragm portion in an obtuse angle form, and wherein the annular flat diaphragm portion is transited to the trumpet-shaped diaphragm portion in another obtuse angle form.

15. The speaker of claim 13, wherein the trumpet-shaped diaphragm portion is convexly disposed toward the hemispherical diaphragm portion.

16. The speaker of claim 13, wherein a first angle between a joint of the annular flat diaphragm portion and the hemispherical diaphragm portion is 90° to 180° , and wherein a second angle between the joint of the annular flat diaphragm portion and the trumpet-shaped diaphragm portion is 90° to 180° .

17. The speaker of claim 13, wherein a thickness of the metal diaphragm is from 6 to 50 micrometers (μm) or from 60 to 300 μm.

* * * * *